United States Patent [19]

Maag

[11] Patent Number: 4,732,380

[45] Date of Patent: Mar. 22, 1988

[54] THIGH HOLDDOWN CLAMP

[76] Inventor: Henry Maag, 15722 Taft La., Apt. 4, Huntington Beach, Calif. 92649

[21] Appl. No.: 827,248

[22] Filed: Feb. 7, 1986

[51] Int. Cl.[4] ..... A63B 23/04

[52] U.S. Cl. ..... 272/132; 272/134; 272/145

[58] Field of Search ..... 272/134, 97, 145, 40, 272/117, 118, 93, 132; 128/80 R, 71, 134; 24/517; 297/466

[56] References Cited

U.S. PATENT DOCUMENTS

| | | | |
|---|---|---|---|
| 717,367 | 12/1902 | Ellis | 24/517 |
| 1,332,566 | 3/1920 | Northrup | 24/517 X |
| 2,046,653 | 7/1936 | Petcoff | 272/145 |
| 2,446,470 | 8/1948 | Godwin | 297/466 X |
| 2,710,650 | 6/1955 | Sowder | 272/40 |
| 3,173,722 | 3/1965 | Carbonetti | 297/466 X |
| 3,285,070 | 11/1966 | McDonough | 272/134 X |
| 4,185,818 | 1/1980 | Brentham | 272/134 X |
| 4,598,908 | 7/1986 | Morgan | 272/134 |

OTHER PUBLICATIONS

"Universal® Physical Conditioning Equipment", 1981–82 Catalog, p. 23, published Jun. 1, 1981.

*Primary Examiner*—Richard J. Apley
*Assistant Examiner*—David Bender

[57] ABSTRACT

An addition to a leg extension and/or leg curl machine, which is used in fixing the positions of an operator's thighs while performing the leg extension or leg curl exercise movement. It is of a simple design which consist of two rigid, frame-journaled, rotating assemblies, one of which is "T" shaped and rotates about the axis of rotation of the machine's rotating effort arm, into and out of a position of engagement with the operator's thighs, and the other of which can be selectively rotated, through operator manipulation, about an axis which is both parallel with and offset from the axis of rotation of the first, into and out of a position of interference with the first. Working together, these two rotating assemblies constitute a quick-engage/release, rigid, thigh constraint device, which employs direct thigh constraint, and is both quicker to use and more comfortable than the non-rigid thigh constraint devices experimented with to date.

1 Claim, 7 Drawing Figures

THIGH HOLDDOWN CLAMP

This invention relates to exercise equipment, in particular to an improved device for constraining an operator's thighs while performing leg extensions or leg curls on an exercise machine which is provided with a pivotally mounted rotating effort arm for performing the exercise.

BACKGROUND AND OBJECTIVE OF THE INVENTION

Leg extension and leg curl machines are exercise machines which are designed to isolate either the quadriceps muscles at the fronts of the operator's thighs (leg extensions), or the hamstrings muscles at the backs of the operator's thighs (leg curls), through fixing the positions of the operator's thighs and applying resistive forces to the operator's lower legs through circular paths about the operator's knee joints (the operator's muscles being developed as they oppose these resistive forces by rotating the lower legs about the knee joints in a direction opposing the resistive forces applied). In order for these exercises to be most effective at isolating the muscles involved, the positions of the thighs must remain fixed while performing the exercise.

With respect to the leg extension, it is not uncommon in a leg extension exercise movement for an operator's thighs to rotate, about the knee joints, up and off of the exercise surface. To correct this problem some equipment designers have added handles, which are secured to the machine's frame, for the operator to hold onto in order to indirectly hold his thighs down while performing the exercise movement. This solution, being indirect, puts significant stresses on the operator's forearms (which must maintain a grip), biceps (which must be contracted to hold the body down), deltoids and trapezious (which must be contracted to fix the positions of the shoulders as the biceps pull). A second approach to correcting the problem of thigh constraint during a leg extension exercise movement, taken by other equipment designers, is to apply direct thigh constraint through the use of a non-rigid thigh constraint device (such as a belt) which straps transversely across the operator's thighs from its positions of attachment on the machine's frame. This approach to thigh constraint also has disadvantages. Due to the fact that the belt is non-rigid, it applies greater stress to the outsides of the operator's thighs, where it changes direction down to its points of attachment on the machine's frame. A second disadvantage to this approach to thigh constraint is the fact that the belt is relatively difficult and time consuming to engage and disengage, especially if it is to fit snuggly against the operator's thighs.

With respect to the leg curl, it is not uncommon for an operator, upon experiencing discomfort or difficulty with the applied loads while performing leg curls, to voluntarily (or without knowing it) rotate his thighs, about the knee joints, up and off of the exercise surface. To the best of the applicant's knowledge, no type of thigh constraint device has been used specifically for the leg curl exercise. The use of handgrips (which would involve indirect thigh constraint), because of the orientation of the operator's body, would obviously be ineffective in constraining the operator's thighs in a leg curl exercise movement, and the use of a non-rigid belt-like thigh constraint device, besides suffering all of the disadvantages set forth in relation to the use of such a device on a leg extension machine, would suffer the added disadvantage of being extremely difficult and time consuming to engage or disengage from the leg curl exercise position.

In view of the advantages of fixing the positions of an operator's thighs while performing leg extensions or leg curls, and the disadvantages of fixing the positions of the thighs through an indirect method (like using handgrips), or a direct method which utilizes a non-rigid constraint device (such as a belt), the object of this invention is to introduce a simple, rigid, direct thigh constraint device which is easily adaptable to a leg extension and/or leg curl machine, and which can be quickly and easily engaged or disengaged from the operating position on such a machine, and which will not appreciably effect access to such a machine.

SUMMARY OF THE INVENTION

The thigh holddown clamp disclosed in this application is composed of two rigid, frame-journaled, mutually interfering, rotating assemblies, which rotate about non-common, parallel, fixed axes. The first of these two assemblies is a rigid "T" shaped thigh holddown arm, which rotates about the axis of rotation of the machine's effort arm, into and out of a position of engagement with the operator's thighs. The second of these two assemblies is a rigid hand lever arm, which is selectively rotated about an axis which is both parallel with and offset from the axis of rotation of the rigid thigh holddown arm. These two rigid rotating assemblies each share one of the two component members of an engaging ratchet wheel/pawl arm pair, and are positioned, relative to each other, so that the ratchet wheel/pawl arm pair can be selectively engaged and disengaged through operator manipulation of the rotating hand lever assembly. Working together, these two rotating assemblies constitute a quick-engage/release, rigid, direct thigh constraint device, which, because it applies direct thigh constraint, eliminates the disadvantage of unnecessary stresses applied to the rest of the operator's body (associated with indirect thigh constraint devices, such as handgrips), and which, because it is rigid, eliminates the disadvantages of poor stress distribution across the operator's thighs, and relative difficulty and time consumption in engaging and disengaging (associated with non-rigid direct thigh constraint devices, such as belts), and which, because it journals to the already present axis of rotation of the machine's effort arm, can be quickly and easily adapted to present day leg extension and/or leg curl machines without appreciably effecting access to those machines.

DESCRIPTION OF THE PREFERRED EMBODIMENT

Figure 2:
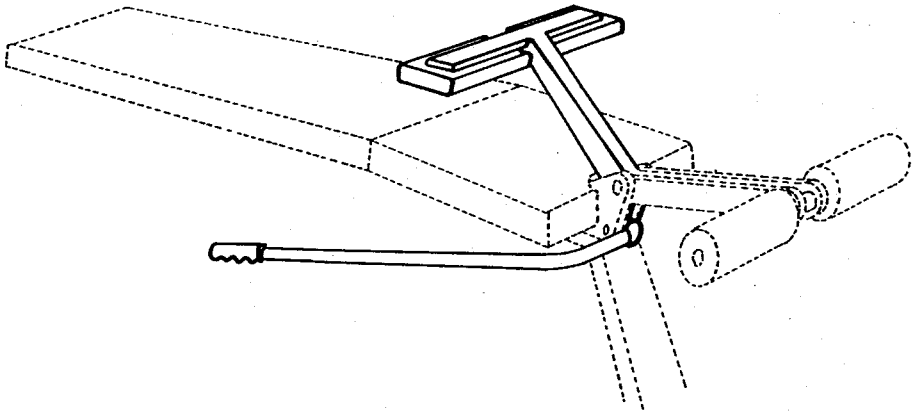
FIG. 2 is a pictorial view of the thigh holddown clamp incorporated into a leg curl machine.
Figure 1:
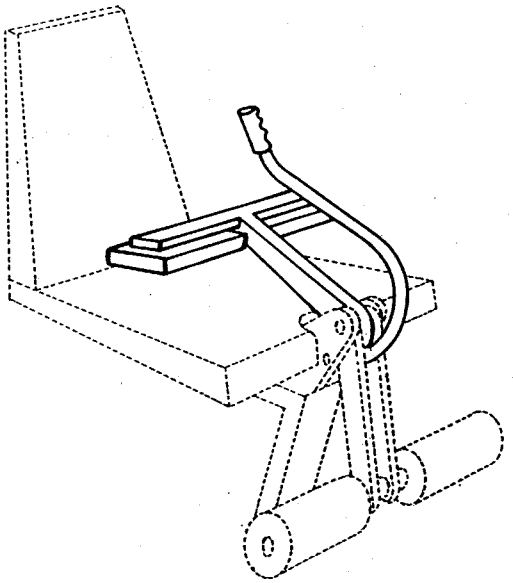
FIG. 1 is a pictorial view of the thigh holddown clamp incorporated into a leg extension machine.
Figure 3:
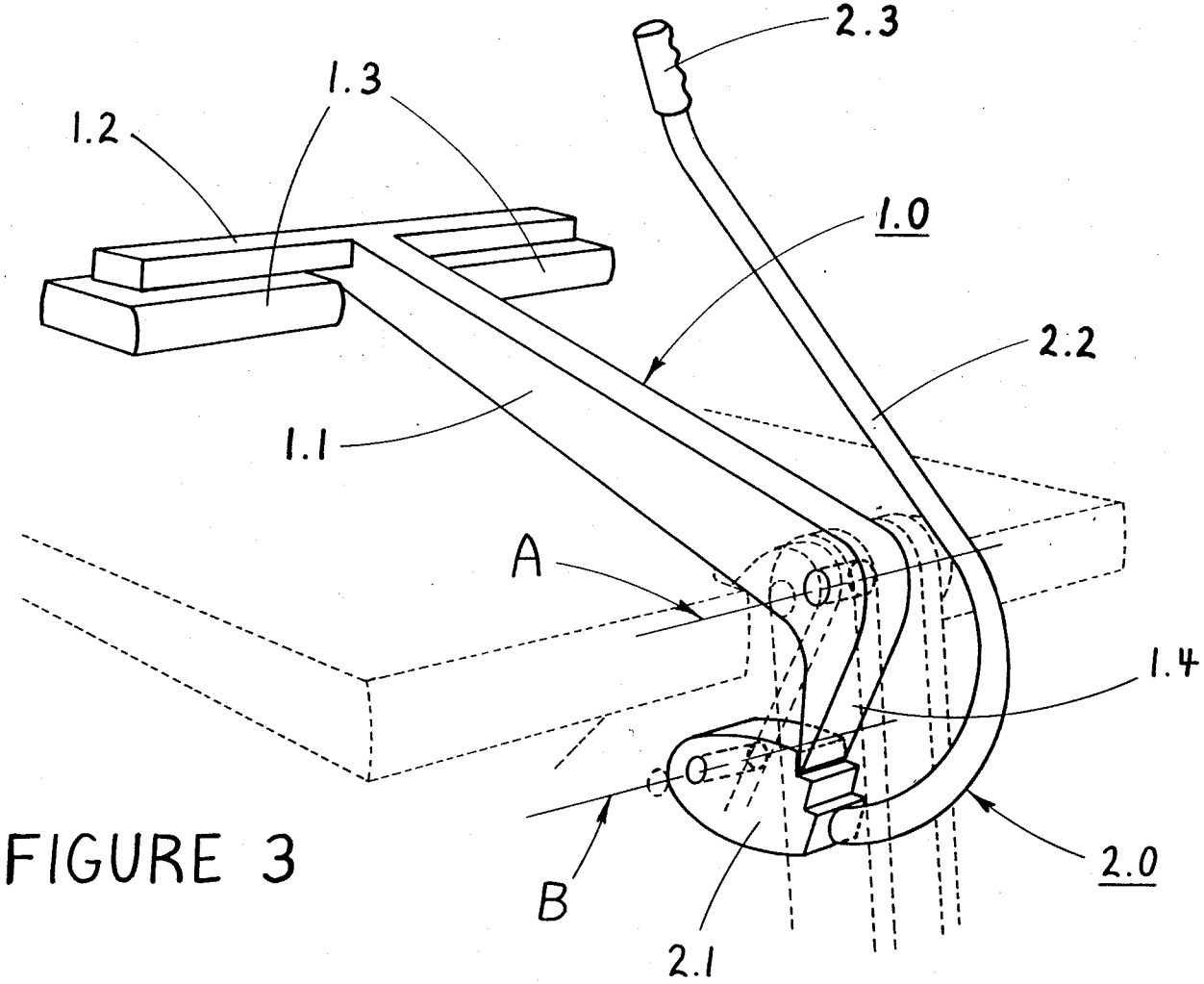
FIG. 3 is a pictorial view of the thigh holddown clamp with all parts labeled.
Figure 7:
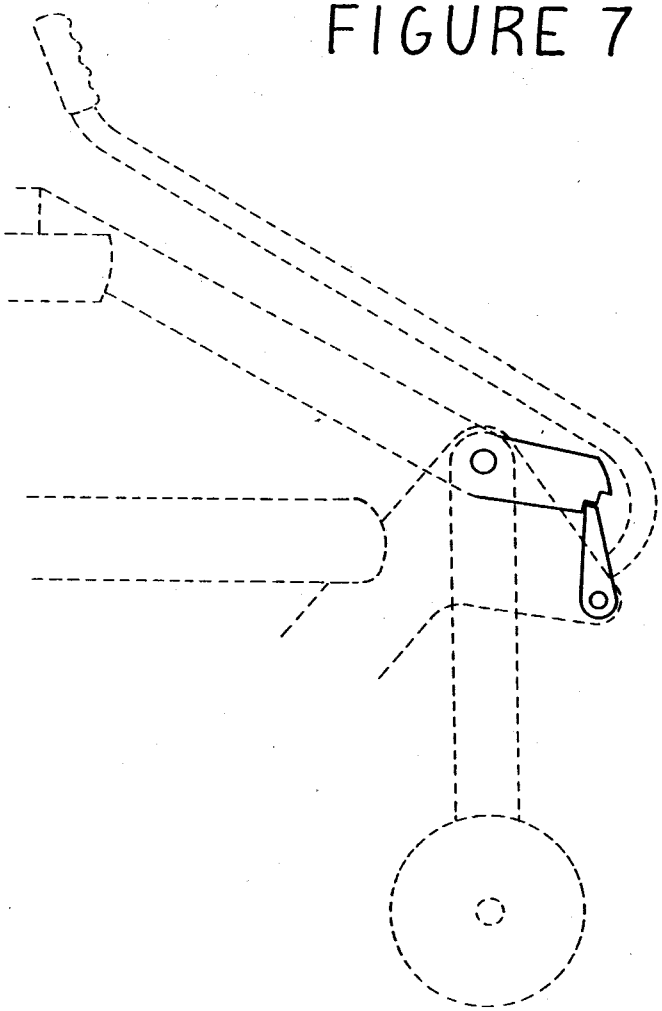
FIG. 7 is an illustration of the two engaging components of the ratchet wheel/pawl arm locking mechanism, the ratchet wheel being on the thigh holddown arm and the pawl arm being on the hand lever arm.
Figure 6:
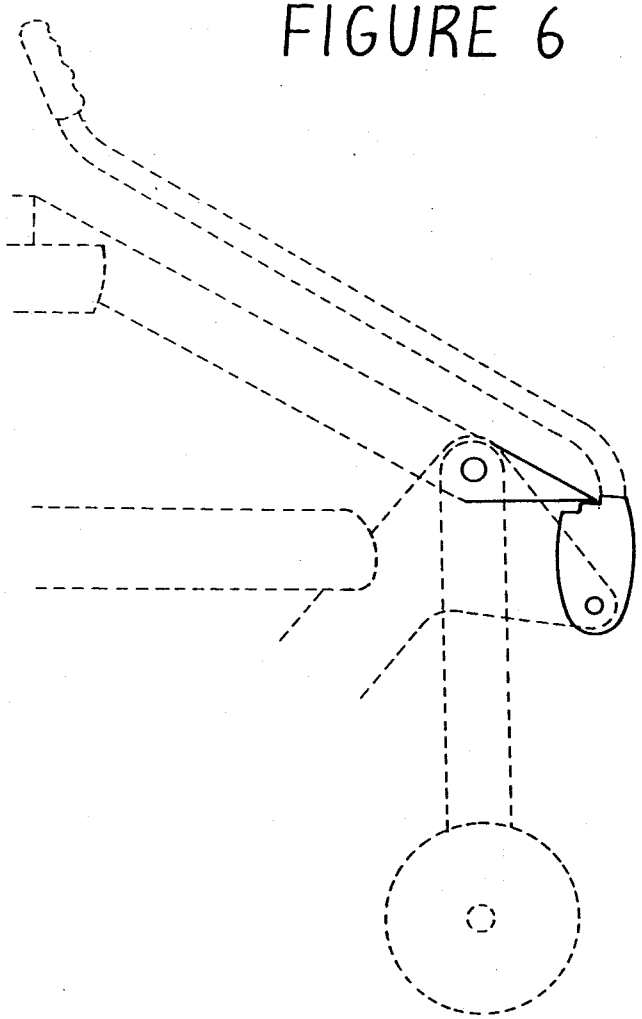
FIG. 6 is an illustration of the two engaging components of the ratchet wheel/pawl arm locking mechanism, the ratchet wheel being on the hand lever arm and the pawl arm being on the thigh holddown arm.

Refer now in detail to FIG. 3, which shows a pictorial view of the thigh holddown clamp with all parts labeled. As shown in FIG. 3, this invention is composed of two rigid rotating assemblies, which are journaled in the frame of a leg extension and/or leg curl machine on non-common, parallel, fixed axes. The first of these two assemblies is a rigid "T" shaped thigh holddown arm (assembly 1.0), which rotates about the axis of rotation of the machine's rotating effort arm (axis A). This rigid thigh holddown arm (assembly 1.0) primarily consist of two rigid members, as shown. The first member (part 1.1) is a rigid member which lies on a line which extends radially outward from the assembly's axis of rotation (axis A), as shown. Joined to the distal end of this first member (part 1.1) is the second member (part 1.2), which lies on a line which is parallel with the assembly's axis of rotation (axis A), as shown. Attached to this second member (part 1.2) are thigh engaging holddown pads (parts 1.3), which are placed so as to engage the upper front of the operator's thighs in the leg extension exercise, or the upper back of the operator's thighs in the leg curl exercise, upon rotation of the assembly toward the operator's thighs. Integral to and sharing a common axis of rotation with this thigh holddown arm (assembly 1.0), is one of the two engaging members of a ratchet wheel/pawl arm pair (shown as a pawl arm in FIG. 3-part 1.4, and as a section of toothed ratchet wheel in FIG. 7). The second of these two assemblies is a hand lever arm (assembly 2.0), which rotates about a second frame-fixed axis (axis B), which is both parallel with and offset from the axis of rotation of the thigh holddown arm (assembly 1.0). This rigid hand lever arm (assembly 2.0) primarily consist of a hand lever (part 2.2) which runs generally radially away from the assembly's axis of rotation (axis B) and ends in a hand grip (part 2.3) at its distal end, which is placed within reach of the operator while performing the exercise. Integral to and sharing a common axis of rotation with this hand lever arm (assembly 2.0), is the second engaging member of the ratchet wheel/pawl arm pair (the engaging counterpart of the member on the holddown arm—shown as a section of toothed ratchet wheel in FIG. 3-part 2.1, where it engages a pawl arm counterpart on the illustrated thigh holddown arm, and shown as a pawl arm in FIG. 7, where it engages a toothed ratchet wheel counterpart on the illustrated thigh holddown arm). As shown in the Figures, these two assemblies (assemblies 1.0 & 2.0) are placed, relative to each other, so that the ratchet wheel/pawl arm pair, of which they share a component, will engage in such a way that the thigh holddown arm (assembly 1.0) will be prevented from rotating up and away from the operator's thighs.

Figure 4:
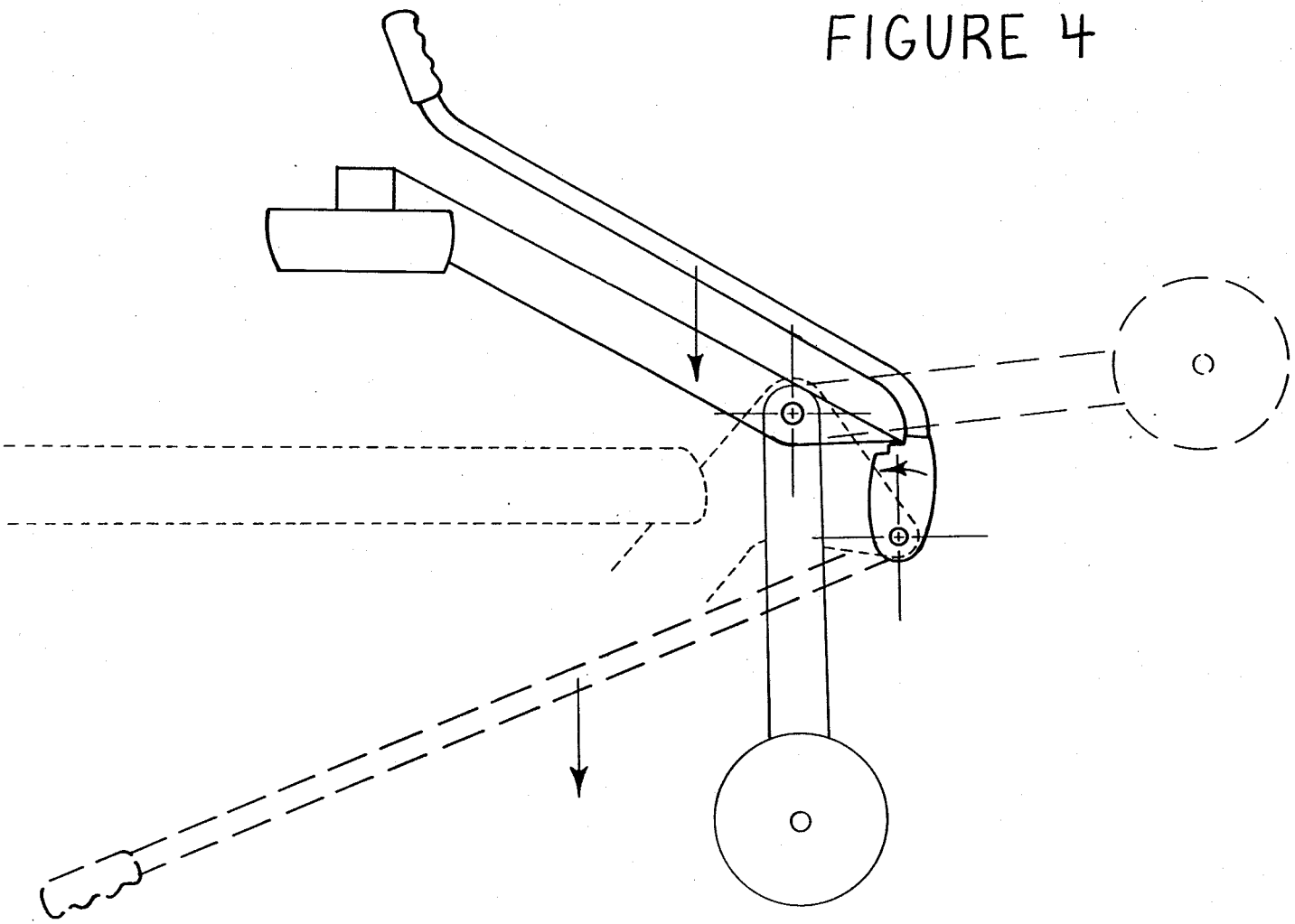
FIG. 4 is a side (plan) view of the thigh holddown clamp showing preferred hand lever routings for either a leg extension machine or a leg curl machine.
Figure 5:
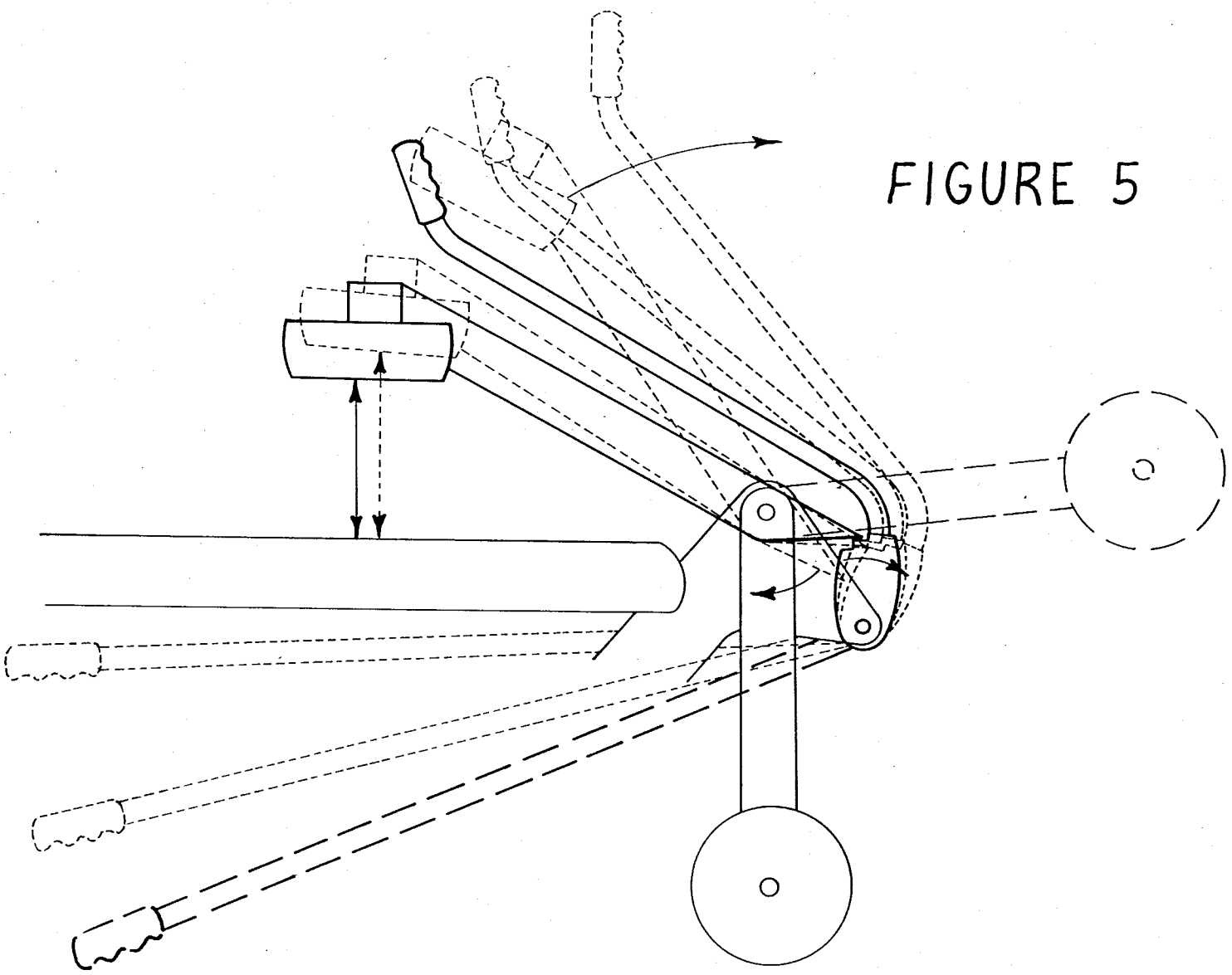
FIG. 5 is a side (plan) view of the thigh holddown clamp illustrating different lock positions (clamping gaps), and clamp release.

As illustrated by force vector arrows in FIG. 4, the rotating hand lever assembly (assembly 2.0) is placed, so that gravity acting on it, tends to make it rotate in such a direction that its pawl or ratchet wheel engages the ratchet wheel or pawl counterpart on the thigh holddown arm (assembly 1.0), and as illustrated in FIG. 5, the ratchet wheel's teeth and the pawl should be oriented to engage at positions which will cause the clamping gap (between the bottoms of the thigh engaging holddown pads and the top of the exercise surface) to correspond to typical, operator, front-to-back thigh depths.

HOW THE INVENTION WORKS

When the engaging ratchet wheel/pawl arm pair, shared between the frame-journaled thigh holddown arm and the frame-journaled hand lever arm, engage, it prevents the thigh holddown arm (assembly 1.0) from rotating up and away from the operator's thighs. Gravity acting on the hand lever arm (assembly 2.0) keeps the pawl or ratchet wheel on this assembly engaged with its counterpart on the thigh holddown arm. When the operator wants to release the thigh holddown arm from its clamped position, he simply raises the handle on the hand lever arm, which causes the pawl or ratchet wheel on this assembly to rotate away from its counterpart member (ratchet wheel or pawl arm) on the thigh holddown arm, which disengages the locking mechanism. Once the locking mechanism is released (the pawl and ratchet wheel, disengaged) the thigh holddown arm can be rotated up and away from the operator's thighs, giving access to get in and out of the machine.

CONCLUSION

This invention constitutes a simple device which directly constrains an operator's thighs while performing leg extensions or leg curls. Because it employs a method of direct thigh constraint, it eliminates the unnecessary stresses applied to the rest of an operator's body, which are associated with methods of indirect thigh constraint (such as the use of handgrips, provided for an operator to hold himself down with). Due to the fact that it is of rigid construction, and includes padded body-machine contact surfaces which apply well distributed constraining forces, directly, to an operator's thighs, it eliminates the problem of poor stress distribution across the operator's thighs, associated with non-rigid direct thigh constraint devices (such as belts). Because this invention is engaged and disengaged from an easily accessible position, and because the locking mechanism does not involve latching or dislatching a belt, it is both easier and less time consuming to use than a thigh constraint device utilizing a thigh constraining belt. Finally, because this invention is mounted to the machine's frame at the axis of rotation of the machine's rotating effort arm, it is both easily adapted to present day leg extension and/or leg curl machines, and does not effect access to these machines anymore than the bearings of their already present effort arms would.

Having thus described the invention and its function, what is claimed is as follows:

1. On a leg exercising machine which utilizes a pivotally mounted rotating effort arm to apply resistive force to an operator's legs while performing leg extensions or leg curls, and a thigh holddown bar which keeps the operator's thighs secured to the exercise machine during exercises, the improvement comprising:

said thigh holddown bar being pivotally attached to said exercise machine so as to pivot about the same axis as said rotating effort arm;

a pawl pivotally attached to said machine to engage and secure said thigh holddown bar at different angular positions about said axis;

an elongated handle attached to said pawl which the user of said machine can position to engage or release the pawl from said thigh holddown bar.

* * * * *